United States Patent [19]

Friedl

[11] Patent Number: 4,629,974

[45] Date of Patent: Dec. 16, 1986

[54] ACTIVE CURRENT TRANSFORMER

[75] Inventor: Richard Friedl, Brunswick, Fed. Rep. of Germany

[73] Assignee: LGZ Landis & Gyr Zug AG, Zug, Switzerland

[21] Appl. No.: 841,008

[22] PCT Filed: Apr. 27, 1984

[86] PCT No.: PCT/EP84/00126

§ 371 Date: Dec. 11, 1984

§ 102(e) Date: Dec. 11, 1984

[87] PCT Pub. No.: WO84/04849

PCT Pub. Date: Dec. 6, 1984

Related U.S. Application Data

[63] Continuation of Ser. No. 682,000, Dec. 11, 1984, abandoned.

[30] Foreign Application Priority Data

May 24, 1985 [DE] Fed. Rep. of Germany ..... 3318749

[51] Int. Cl.[4] ..... H01F 40/06

[52] U.S. Cl. ..... 323/357; 323/347; 324/127

[58] Field of Search ..... 323/264, 347–348, 323/356–358; 324/117 R, 123 R, 123 C, 127; 336/173

[56] References Cited

U.S. PATENT DOCUMENTS 3,916,310 10/1975 Stark et al. ..... 324/127

FOREIGN PATENT DOCUMENTS

| | | |
|---|---|---|
| 1638883 | 8/1970 | Fed. Rep. of Germany . |
| 2330048 | 12/1974 | Fed. Rep. of Germany . |
| 2359756 | 6/1975 | Fed. Rep. of Germany . |
| 2802129 | 7/1979 | Fed. Rep. of Germany . |
| 3140544 | 4/1983 | Fed. Rep. of Germany . |
| 2003847 | 11/1969 | France . |
| 2232761 | 1/1975 | France . |
| 0467505 | 2/1969 | Switzerland . |
| 0022248 | of 1915 | United Kingdom . |
| 0198714 | 6/1923 | United Kingdom . |

OTHER PUBLICATIONS

Dr. Richard Feldtkeller, "Spulen und Uebertrager", published by S. Hirzel Verlag, Zurich/1949, pp. 26 & 27.

*Primary Examiner*—Peter S. Wong

*Attorney, Agent, or Firm*—Marmorek, Guttman & Rubenstein

[57] ABSTRACT

A current transformer equipped with a primary winding (1), a secondary winding (2), as well as a detector winding (3), has a rigid coupling between the secondary winding (2) and the detector winding (3). The coupling factor between these windings (2, 3) and the primary winding (1) is considerably smaller than one, since only one portion of the magnetic flux $\phi_1$ created in the primary winding (1) by the current $I_1$ to be measured is detected by the detector winding (3). This partial flux $\phi_{13}$ is compensated by the flux which is created in the secondary winding (2) by means of a variable-gain amplifier.

14 Claims, 13 Drawing Figures

ACTIVE CURRENT TRANSFORMER

This is a continuation, of application Ser. No. 682,000, filed Dec. 11, 1984 now abandoned.

BACKGROUND OF THE INVENTION

The invention relates to an active current transformer of the type having a primary winding conveying current to be measured 1; with $W_1$ turns and a secondary winding conveying measuring current $I_2$ with $W_2$ turns and a detector winding coupled with the secondary winding whereby means of a variable gain amplifier, the induced voltage of the detector winding creates a current in the secondary winding, the magnetic flux of which compensates the magnetic flux permeating the detector winding and produces large current transforming ratio.

DESCRIPTION OF PRIOR DISCLOSURES

Current transformers with electronic error compensation are known for example, from German Pat. No. 23 30 048. In such current transformers the coupling factor K, which is solely determined by means of the magnetic conductance values, is always practically one. This is achieved through the closed magnetic circuit, so that the transforming ratio of the transformer is determined by the ratio of the number of turns of the primary- and of the secondary windings. A remaining slight current error is eliminated through the compensation of the magnetic flux. In the case of high transforming ratios with correspondingly high circulations, this current transformer requires considerable material and space, since the entire primary flux has to be compensated.

In particular during the measuring of the current intensities of high alternating currents, circulations of considerably higher orders of magnitude are produced by the primary winding than transformers, equipped with a ferromagnetic core, require for the faultless functioning of the magnetic core. For the reduction of the expenditure required hereby in magnetic material, as well as reduce space- and cost-requirements, transformers also are known, whose magnetic core surrounds only a portion of the cross-sectional area of the conductor carrying the measuring current. Particular problems arise thereby in regard to the relatively high temperature dependence and the necessity of eliminating principle-conditioned phase errors between the primary- and secondary-current through special measures.

There is known also, an active current transformer where the current to be measured is distributed over two conductors which are separated from one another, which are wound in the opposite sense of direction for the formation of the primary winding and whose resistance values are different from one another German Pat. No. OS 31 40 544).

Moreover, active current transformers are known which completely dispense with the ferromagnetic cores (see German Pat. No. OS 28 12 303), and where the secondary winding is toroidal and, through which the primary conductor carrying the measuring current passes through. Although such transformers operate relatively accurately, their mechanical design is too expensive for mass production.

In the case of the known current transformers, coupling factor $K=1$ between the primary as well as the secondary winding is always, whereby the transforming ratio is solely determined by the ratio of the number of turns of these windings.

OBJECTS OF THE INVENTION

The invention is to provide a current transformer the main object of which, in comparison to known transformers, can be designed more simply and can be produced more economically while performing at least as well from the viewpoint of measuring technique.

Other objects of the invention will be obvious from the following description of the heat modes of the invention.

SUMMARY OF THE INVENTION

In the current transformer designed according to the invention, the current transforming ratio, in contrast to the known arrangements, is not exclusively determined by the ratio of the number of turns of the primary and secondary winding, but is moreover determined to a considerable measure by the coupling factor, which indicates the ratio of partial flux to total flux. Through the selection of a coupling factor which lies considerably below one, the transforming ratio can be adjusted within wide limits without changing the number of turns, so that the secondary- and detector-winding can be executed in a comparatively small order of magnitude. Whereas in the case of the known transformers the coupling factor $K=1$ is sought, the transformers of the invention deviate distinctly from this value in order to adjust the desired high transforming ratios with the aid of the coupling factor, and thus with the secondary-side partial-flux detection. Also in the case of the present transformer, the compensation of the current error takes place in known manner through the selection of a suitable amplification.

In the case of an arrangement without ferromagnetic material, the coupling factor is attained by means of a sufficiently great geometric distance between primary- and detector-winding or secondary-winding. Where ferromagnetic materials are used, the coupling factor is furthermore influenced by the permeability of these materials.

The current transformer with high current ratio designed according to the invention, primarily distinguishes itself from the known arrangements through further considerable simplifications, by insensitivity with respect to changes in temperature and by phase errors of small orders of magnitude. Another advantage is the simple assembly of the primary conductor with the other necessary components, by introducing (inserting) these components into the magnetic field of the current flowing within the primary conductor, so that, for example, the exchange of these components can be also undertaken without having to open the primary electric circuit a further advantage is the unlimited operation in the case of the presence of direct current components in the primary- and secondary-electric-circuit. Beyond this, the utilization of the arrangement designed according to the invention displaying the known switching arrangements of the digital flux compensation in the secondary circuit, as well as the known blanking of the magnetic flux by means of saw-tooth signals are particularly suited since, owing to the slight impedance of the secondary winding, the frequency of the measuring cycle can be selected relatively high. Depending on the preuse application, the present current transformer can be equipped with or without ferromagnetic materials. The new transformer is suited particularly for use in electric meters for single- and multiphase alternating current.

BRIEF DESCRIPTION OF THE DRAWING

Further features of the invention will be apparent from the appended drawings which show by way of non-limiting examples bent modes of the invention, and wherein.

REFERRING DESCRIPTIVELY TO THE DRAWING

Figure 1A:
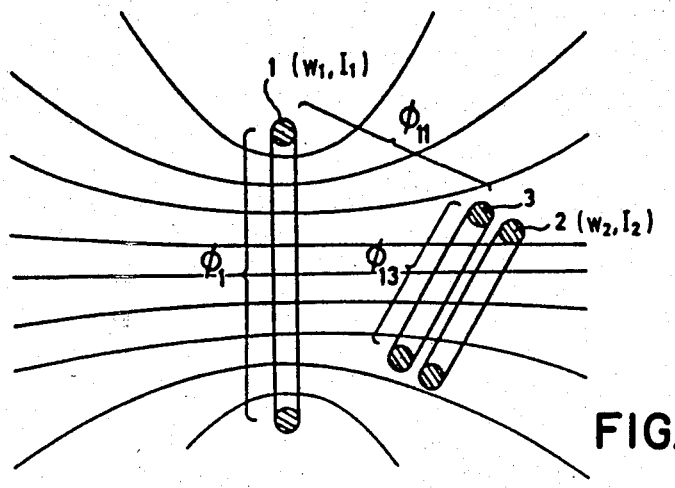
FIG. 1*a* shows a basic representation of the current transformer designed according to the invention.

FIG. 1*a* represents the invention in the most general manner one shows the arrangement of a mutual inductance, which consists of a primary winding 1 conveying the alternating current $I_1$ to be measured and having a number of turns $W_1$, whereby the magnetic flux $\phi_1$ passes through the winding surfaces of the primary winding 1, a detector-winding 3 which is permeated by the partial flux $\phi_{13}$, that is to say by a portion of the flux $\phi_1$, whereas the other portion $\phi_{11}$, as leakage flux, does not permeate the winding 3. A secondary winding 2 with the number of turns $W_2$, is relatively rigidly coupled with the winding 3.

Figure 1B:
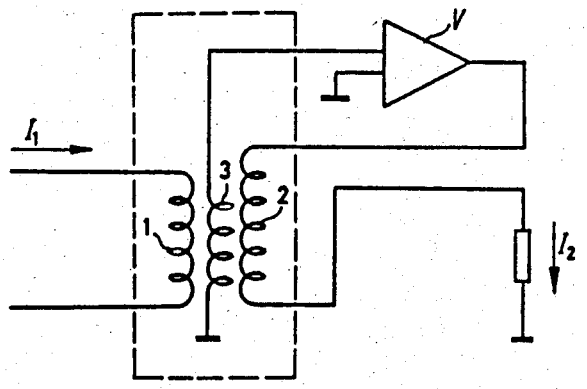
FIG. 1*b* is a basic circuit diagram of a known compensated current transformer.

In the case of the presence of the partial flux $\phi_{13}$, as it is known in the case of compensated current transformers (FIG. 1*b*), the voltage induced in the detector-winding 3 is conveyed to an amplification-arrangement V, which builds up such a current $I_2$ in the secondary winding 2, so that the partial flux $\phi_{13}$, which permeates the detector winding 3, is practically completely compensated at conventionally high amplification, whereby the coupling factor is not influenced by the amplification. Under those conditions, the secondary measuring current $I_2$ is proportional, to a very precise degree, to the current $I_1$ in the winding 1 which is to be measured to increase the transforming ratio, the current transformer designed according to the invention uses a coupling factor K, which is considerably smaller than one. According to FIG. 1*a*, the coupling factor K amounts to $K=\phi_{13}/\phi_1$ and leads to the following transforming ratio, namely:

$$I_1/I_2 = \frac{1}{K} \cdot \frac{W_2}{W_1}.$$

Figure 2:
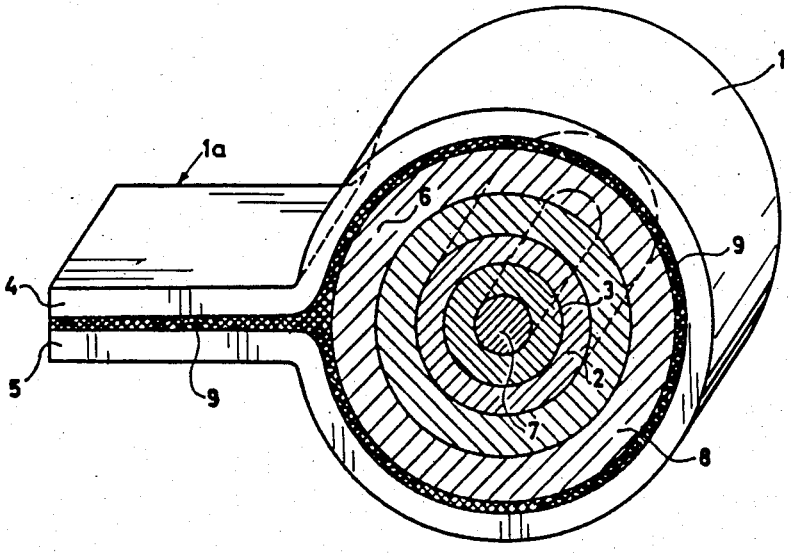
FIG. 2 is a perspective view which shows a current transformer with a flat conductor.

FIG. 2 represents an advantageous embodiment of the current transformer using a ferromagnetic material and designed according to the invention. The transformer displays a flat conductor 1*a* conveying the current to be measured, which conductor 1*a* is provided with current supplying elements 4 and 5 and forms the primary winding 1 with only one winding $W_1$. The flat conductor 1*a* surrounds a tube section 6 which consists of ferromagnetic material, which tube section 6, on its part, concentrically surrounds a cylindrical ferromagnetic core-rod 7 also of ferromagnetic material, and onto which the windings 3 and 2 are applied. Between the two legs of the flat conductor 1*a*, in the area of the current-supplying elements 4 and 5 and between the cylindrical primary winding 1 which is formed by the flat conductor 1*a* and the ferromagnetic tube section 6, lies an electrically insulating layer 9. The ferromagnetic core-rod 7 with the windings 3 and 2, facing the tube section 6, is filled with an insulating material in the ring-shaped area 8 or is anchored by other mechanical means.

The mode of operation of the device is the following: The magnetic field created by the current $I_1$ to be measured is subdivided in the cylindrical primary winding 1, defined by the ferromagnetic tube section 6 and the ferromagnetic rod 7, into two magnetic fluxes the mutual relationship of which is substantially determined by the magnetic conductivities of the two ferromagnetic parts 6 and 7. Consequently, in the case of the same ferromagnetic material (for example ferrite material) and a radial-symmetrical arrangement of the core rod 7 in the tube section 6 and for the same length of parts 6 and 7, the ratio of division of the magnetic fluxes and therewith the coupling factor K are primarily determined by the relationship of the radial intersecting surfaces lying perpendicularly to the longitudinal axis of the tube or of the rod. The magnitude of the coupling factor K can be further reduced through shortening of the core rod 7 while the length of the tube section 6 remains the same. Among others, a change of the coupling factor can also take place by moving the core rod 7 in its longitudinal direction.

Figure 3A:
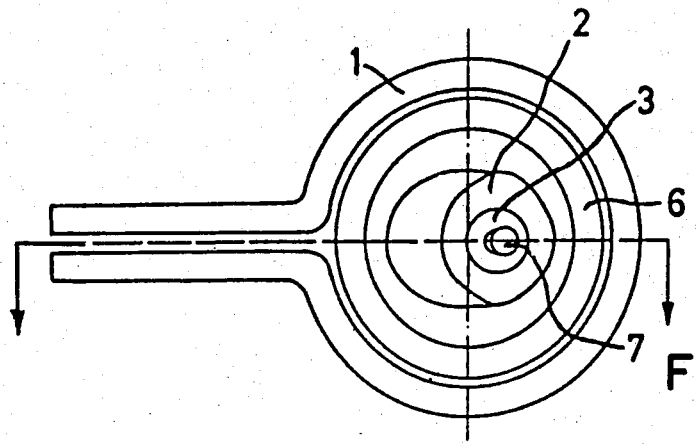
FIG. 3*a* shows a frontal view of the transformer designed according to FIG. 2, with a device for the adjustment of the coupling factor.
Figure 3B:
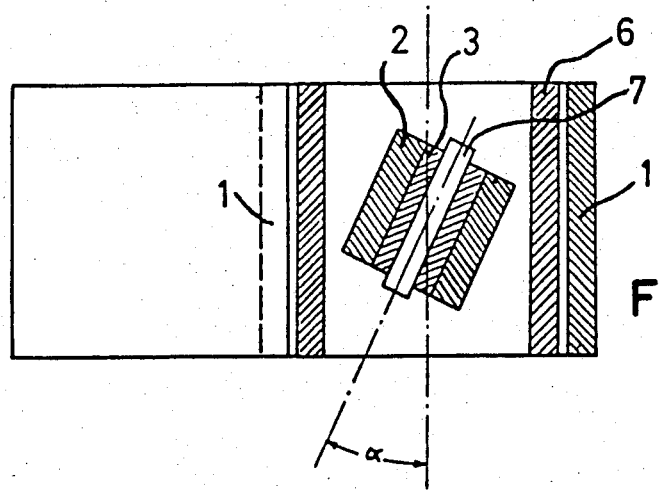
FIG. 3*b* is a longitudinal section through the transformer designed according to FIG. 3*a*.

In accordance with FIGS. 3*a* and 3*b*, a reduction of the magnitude of the coupling factor can also be achieved by rotating core rod 7 with the windings 3 and 2 in an angular position with respect to the tube section 6, so that the winding 3 penetrates only a portion of the maximum detectable magnetic flux.

Figure 4:
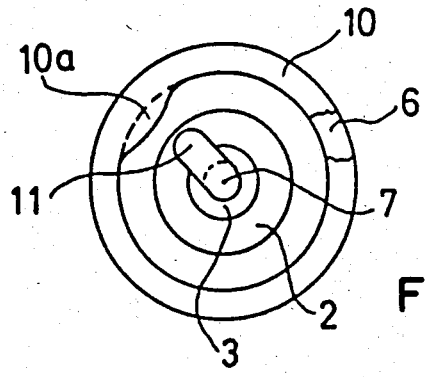
FIG. 4 is a frontal view of the transformer designed according to FIG. 2, with a device for the adjustment of the coupling factor, which device is changed with respect to the design shown in FIGS. 3*a* and 3*b*.

FIG. 4 shows one of many possibilities how the coupling factor can be finely adjusted for the device of FIG. 2. On a frontal extremity of the tube section 6, a circular ring-shaped ferromagnetic piece of sheet metal 10 with a radial, inward directed, lug 10*a* is mounted. On the corresponding frontal side of the ferromagnetic core rod 7, a ferromagnetic lug 11 made of sheet metal is mounted in a pivotable manner which, when approaching the lug 10*a* of the sheet metal 10, increases the coupling factor and decreases the same when turning away from sheet metal 10. The same effect can be achieved with the fine adjustment embodiment of FIG.

Figure 5:
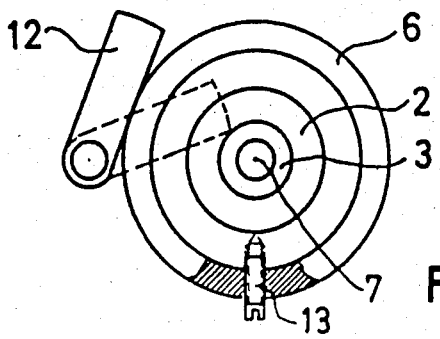
FIG. 5 is a frontal view of the transformer designed according to FIG. 2, with two further devices for the adjustment of the coupling factor.

5, in that a ferromagnetic lug 12 made of sheet metal is rotatably mounted eccentrically with respect to the tube section 6 on, or, in the vicinity of the tube section 6 and is rotated above the field which emerges from the tube section 6 until the desired transformation is present. In addition, possibilities exist of sensitively influencing the field course by means of ferromagnetic screws 13 and therewith sensitively influencing the flux distribution between the tube section 6 and the core rod 7 (FIG. 5).

Residual phase errors can be compensated by appropriately loading the partial fluxes with metal particles in which eddy currents can be formed.

For the concentration of the magnetic field lying outside of the primary winding 1 (FIG. 2), a ferrite cylinder or a ferrite can, which is slit at the outer side for the passage of the current-supplying elements 4 and 5, can be placed over the winding.

Figure 6:
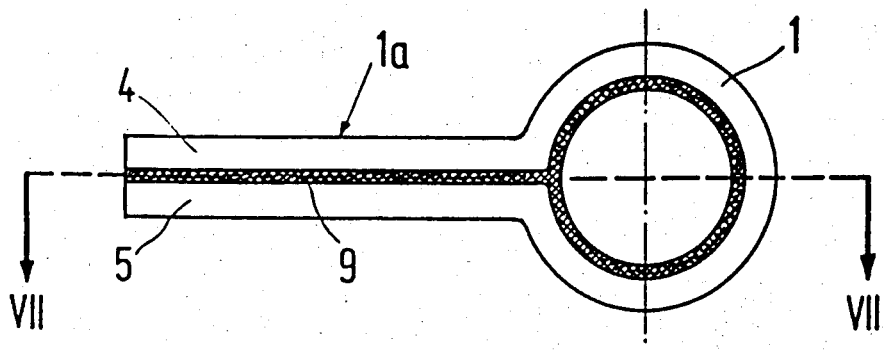
FIG. 6 is a frontal view of the transformer with a device for the reduction of the influence of external foreign fields.
Figure 7:
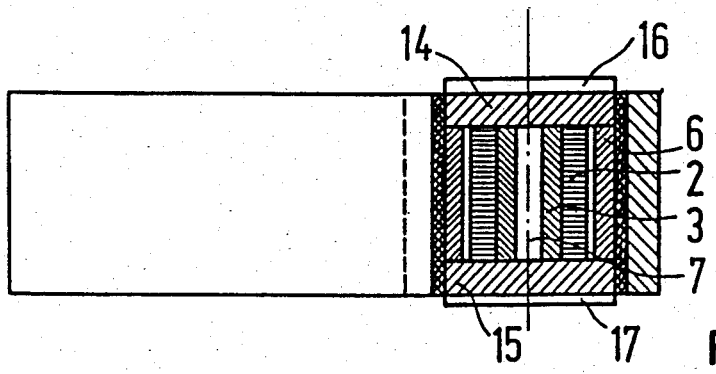
FIG. 7 is a cross-section through the transformer designed according to FIG. 6 taken, along the line VII—VII.

For very accurate measurements it is expedient to screen-off external fields, in particular those which, in axial direction of the tube arrangement, lie over the useful field. For this purpose, as it is shown in FIGS. 6 and 7, the lengths of the tube section 6 and of the core rod 7 with the windings 3 and 2, are made shorter than the axial length of the cylindrical primary winding 1 formed by the flat conductor 1*a*, and the frontal extremities of the primary winding 1 are closed-off by means of circular ferromagnetic covers 16 and 17, whereby these covers are retained at a distance from the ferromagnetic components 6 and 7 through the intervention of the non-magnetic discs 14 and 15. Through this measure, all the components which are present within the annular section of the flat conductor—in a given case, inclusive of electronic elements—can be inserted as a common block into the conductor tube.

Figure 8A:
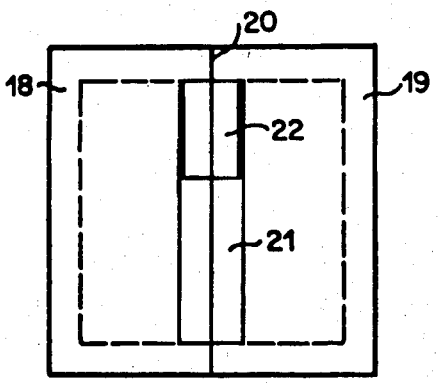
FIG. 8*a* is a side view of a screen-can.
Figure 8B:
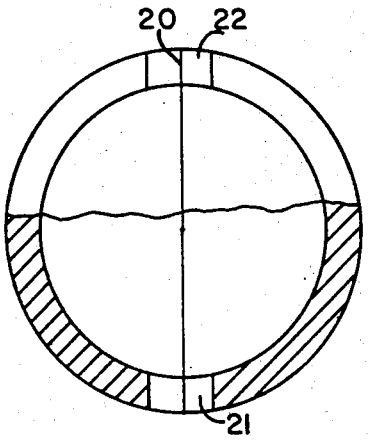
FIG. 8*b* is the screen-can according to FIG. 8*a* in the frontal view, partially in cross-sectional view.

In the case of high external foreign fields it is expedient to arrange the primary winding 1, the windings 2 and 3, the tube section 6 and the rod core 7 within an extensively closed-off, advantageously cylindrical screen-can made of ferromagnetic material, as shown in FIGS. 8*a* and 8*b*. Hereby, the screen-can advantageously consists of two shell halves 18 and 19, whereby the contact surfaces 20 of the two shell halves 18 and 19, the longitudinal axis of the screen can 18, 19 and therewith also the longitudinal axis of the tube section 6 (FIG. 2) lie in a common plane. The two half shells 18 and 19 are provided with openings 21 and 22 for leading through the current-supplying elements 4, 5 (FIG. 2) of the flat conductor 1*a* and the connections of the windings 2 and 3. During the assembly, the half shells 18 and 19 are folded over the described current transformer. In this manner, the internal transformer component can be exchanged at the operating site also in the case of a current-carrying flat conductor 1*a*.

Figure 9A:
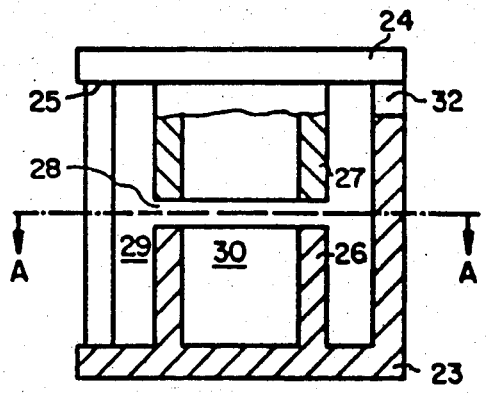
FIG. 9*a* is a side view of a further screen-can.
Figure 9B:
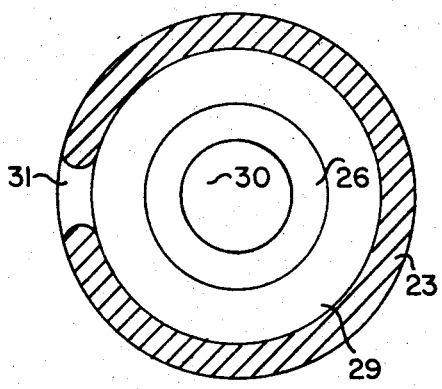
FIG. 9*b* is a cross-section through the screen-can according to FIG. 9*a* taken, along the line A—A.

FIGS. 9*a* and 9*b* show an exemplified embodiment of a cylindrical screen-can consisting of two shell sections 23 and 24, whose contact surfaces 25 lie in a plane which is perpendicular to the longitudinal axis of the screen-can 23, 24 and therewith is perpendicular to the longitudinal axis of the tube section 6 (FIG. 2). In the illustrated example, the shell section 23 is formed as the can and the shell section 24 as the cover. Onto the inner side of the circular front side of the shell section 23 or 24, a tube projection 26 or 27 is formed. These tube projections 26 and 27 together form the tube section 6 (FIG. 2) for the purpose of flux division, whereby the air gap 28 between the opposite lying front surfaces of the tube projections 26 and 27 serves for a severing of the magnetic circuit and therewith prevents a magnetic short-circuit. The hollow cylindrical space 29 between the outer surface of the screen-can 23, 24 and the tube projections 26, 27 serves for the uptake of the primary winding 1 or of the flat conductor 1*a* and the space 30 in the interior of the tube projections 26, 27 serves for the uptake of the core-rod 7, of the secondary winding 2 and of the detector winding 3. For leading through the current-supplying elements 4, 5 of the flat conductor 1*a*, an opening 31 is provided in the screen can 23, 24 and for the leading through of the coil wires to space 30, an opening 32 is provided.

It was found that the coupling factor K and the linearity of the described current transformer are mainly determined by the size relationships $B_p$:$L_m$, $L_m$:$L_s$ and $D_p$:$D_m$. Thereby $B_p$ signifies the width of the flat conductor 1*a*

$L_m$ signifies the length of the tube section 6

$L_s$ signifies the length of the tubular windings 2 and 3

$D_p$ signifies the internal diameter of the tube formed by the flat conductor 1*a*, and $D_m$ signifies the external diameter of the tube section 6.

The most favorable compromise between a small coupling factor K together with a large winding space, on the one hand, and a good linearity on the other hand, results from $B_p$:$L_m$=2:1, $L_m$=$L_s$ and $D_p$:$D_m$=2:1.

Moreover, owing to the small proportion in ferromagnetic material (iron powder, ferrite), the arrangement designed according to the invention is suited for the feeding of a saw-tooth signal of relatively high frequency into the winding 2, whereby in the case of electronic multiplying arrangements in accordance with the so called "time-division"-method, the zero passages of the voltage at the detector winding 3 are directly available as keying ratio for the control of the second quantity to be measured.

I claim:

1. A current transformer comprising a primary winding conducting a current to be measured ($I_1$) and having $W_1$ turns; a secondary winding conducting a measuring current ($I_2$) and having $W_2$ turns;

a detector winding substantially rigidly coupled to said secondary winding and providing an induced voltage;

an amplifier receiving current induced in said detector winding for varying current $I_2$ in said secondary winding; said induced voltage of said detector winding creating in said secondary winding a current having a magnetic flux which compensates the magnetic flux permeating said detector winding, said transformer providing a large current transforming ratio $$\frac{I_1}{I_2} = \frac{1}{K} \frac{W_2}{W_1}$$

by said detector winding picking up a magnetic partial flux $\phi_{13}$ of total magnetic flux $\phi_1$ produced by said primary winding whereby the coupling factor K, which is determined by the ratio of said partial flux $\phi_{13}$ to said total flux $\phi_1$, is considerably smaller than one.

2. Transformer according to claim 1, wherein for further decrease of said factor said detector winding and said secondary winding have surfaces rotatable by an angle ($\alpha$) with respect to the direction of the magnetic field of said current $I_1$ in said primary winding.

3. A transformer as defined in claim 1 further including a ferromagnetic material, a flat conductor forming said primary winding which conveys current $I_1$ to be measured; said conductor being tubular with radial outwardly pointed current-supplying elements, and within said conductor, a ferromagnetic tube section; said section surrounding a ferromagnetic core bearing said secondary winding and said detector winding.

4. The transformer of claim 3, wherein said tube section and said core are geometrically and magnetically asymmetrical to finely adjust the transforming ratio.

5. The transformer of claim 3 further including metal securing means for said tube section and core to finely adjust said transforming ratio.

6. Transformer according to claim 3, wherein said flat conductor has a given axial length, said tube section and said core being shorter than said flat conductor; and has covers consisting of magnetically conducting screening material closing off said tube section at each frontal side, whereby the influence of external fields on said transformer is reduced.

7. Transformer according to claim 3, further including a screen of ferromagnetic material; said windings, said tube section and said core being arranged in said screen.

8. Transformer according to claim 7, wherein said screen consists of two half shells, said shells having contact surfaces lying along a common plane with the longitudinal axis of said tube.

9. Transformer according to claim 7, wherein said screen consists of two half shells, said shells having contact surfaces lying along a plane perpendicular to the longitudinal axis of said tube.

10. Transformer according to claim 3, wherein said tube section consists of two projections separated by an air gap.

11. Transformer according to claim 3, wherein the ratio of the width of said flat conductor to the length of said tube section is about 2:1.

12. Transformer according to claim 3, wherein the length of said tube section is about equal to the lengths of said secondary winding and of said detector winding.

13. Transformer according to claim 3, wherein the ratio of the internal diameter of said flat conductor to the external diameter of said tube section is less than 2:1.

14. Transformer according to claim 13, wherein said ratio is equal to 2:1.

* * * * *